US006237648B1

(12) United States Patent
Busacca et al.

(10) Patent No.: US 6,237,648 B1
(45) Date of Patent: May 29, 2001

(54) METHOD AND DEVICE TO RECOGNIZE AND INDICATE A DISCHARGE VESSEL FILLING LEVEL IN A VACUUM SYSTEM

(75) Inventors: Silvia Busacca, Palermo; Antonino Cuce', Messina; Antonino Cucuccio, Catania, all of (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/408,815

(22) Filed: Sep. 29, 1999

(30) Foreign Application Priority Data

Sep. 30, 1998 (EP) ..... 98830572

(51) Int. Cl.[7] ..... A47L 9/19

(52) U.S. Cl. ..... 141/95; 141/1; 141/59; 141/65

(58) Field of Search ..... 141/1, 59, 65, 141/95, 198

(56) References Cited

U.S. PATENT DOCUMENTS

| | | | | |
|---|---|---|---|---|
| 3,893,493 | * | 7/1975 | Foirest et al. | 141/95 |
| 5,233,682 | * | 8/1993 | Abe et al. | 395/61 |
| 5,251,358 | * | 10/1993 | Moro et al. | 15/319 |
| 5,351,725 | * | 10/1994 | Suthergreen et al. | 141/1 |
| 5,412,752 | * | 5/1995 | Baseshore et al. | 395/3 |
| 5,476,154 | * | 12/1995 | Sage | 141/65 |
| 5,507,067 | * | 4/1996 | Hoekstra et al. | 15/319 |
| 5,562,132 | * | 10/1996 | Siegele et al. | 141/198 |
| 5,710,868 | | 1/1998 | Basehore | 395/3 |
| 5,941,305 | * | 8/1999 | Thrasher et al. | 166/53 |

FOREIGN PATENT DOCUMENTS

| | | |
|---|---|---|
| 4304263 | 4/1994 | (DE) . |
| 4434392 | 2/1996 | (DE) . |
| 0 488 883 A2 | 6/1992 | (EP) . |
| 2 004 180 | 3/1979 | (GB) . |

* cited by examiner

*Primary Examiner*—J. Casimer Jacyna
(74) *Attorney, Agent, or Firm*—Robert Iannucci; Theodore E. Galanthay; Seed IP Law Group PLLC

(57) ABSTRACT

The invention relates to a method and a device for recognizing and warning of the level of fullness of a waste container in a suction system driven by a motor and provided with an internal chamber kept under suction pressure and comprising the waste container. The method foresees a measurement of the difference of pressure between the internal chamber and the environment outside the vacuum cleaner and an elaboration of such measurement according to a set of rules in fuzzy logic for producing an electric warning signal corresponding to the filling level of the waste container.

21 Claims, 4 Drawing Sheets

VOID

FLOOR

CARPET

METHOD AND DEVICE TO RECOGNIZE AND INDICATE A DISCHARGE VESSEL FILLING LEVEL IN A VACUUM SYSTEM

TECHNICAL FIELD

The present invention relates to a method and to a device for recognizing the level of fullness of a waste container in a suction system and, in particular, to a method and device for recognizing the level of fullness of a waste container in a suction system that includes a suction appliance driven by a motor and provided with an internal chamber kept under suction pressure and that also includes the waste container.

BACKGROUND OF THE INVENTION

As is well known even to laymen, in the sphere of work of a suction system for domestic or industrial appliances it is necessary to periodically remove or empty the collection container of the material which has been collected.

Suction systems generically describe suction appliances or vacuum cleaners driven by a motor and provided with an internal chamber comprising a filter and a collection container, referred to herein as waste container.

In this context, one recurring problem is that of recognizing the level of fullness of the waste container. This information is important both for efficient working and for a good yield from the suction system.

In fact, the working principle of a vacuum cleaner foresees that inside the appliance there is a chamber comprising the waste container and where a suction pressure is created by means of the action of the motor. The suction force of the vacuum cleaner is precisely due to the difference in pressure between the internal chamber at a low pressure and the external room pressure.

If the rotation speed of the motor is kept constant, as the waste container begins to fill up the pressure in the internal chamber tends to fall because of the presence of material which has been collected occupies space and obstructs pores in a filter, with a consequent drop in suction force.

Various solutions are currently available that allow the user to receive a warning signal when the waste container is completely full. However, nothing in the prior art offers any effective information on the actual instantaneous level of waste in the waste container and, as already said previously, this does not allow the vacuum cleaner to be used at its full potential.

SUMMARY OF THE INVENTION

One of the embodiments of this invention utilizes a controller helped by Fuzzy logic to create a sensor or level identifier incorporated in the suction system.

On the basis of such idea, a method is given for recognizing and warning of the level of filling of a waste container in a system of suction that includes a suction appliance driven by a motor and provided with an internal chamber maintained under suction pressure. The method includes foreseeing a measure of the difference in pressure between the internal chamber and the room outside the vacuum cleaner and processing the measurement through a set of rules using Fuzzy logic for producing an electric signal corresponding to the fullness level of the waste container.

Additionally, a device is provided that recognizes and indicates a level of fullness of a waste container in a system of suction that includes a suction appliance driven by a motor and provided with an internal chamber kept under suction pressure and including the waste container. The device includes a pressure sensor coupled to the chamber for detecting its suction pressure value and an electronic controller downstream of the sensor operating in fuzzy logic for supplying in output an electric signal corresponding to the fullness level of the waste container.

DETAILED DESCRIPTION

Figure 1:
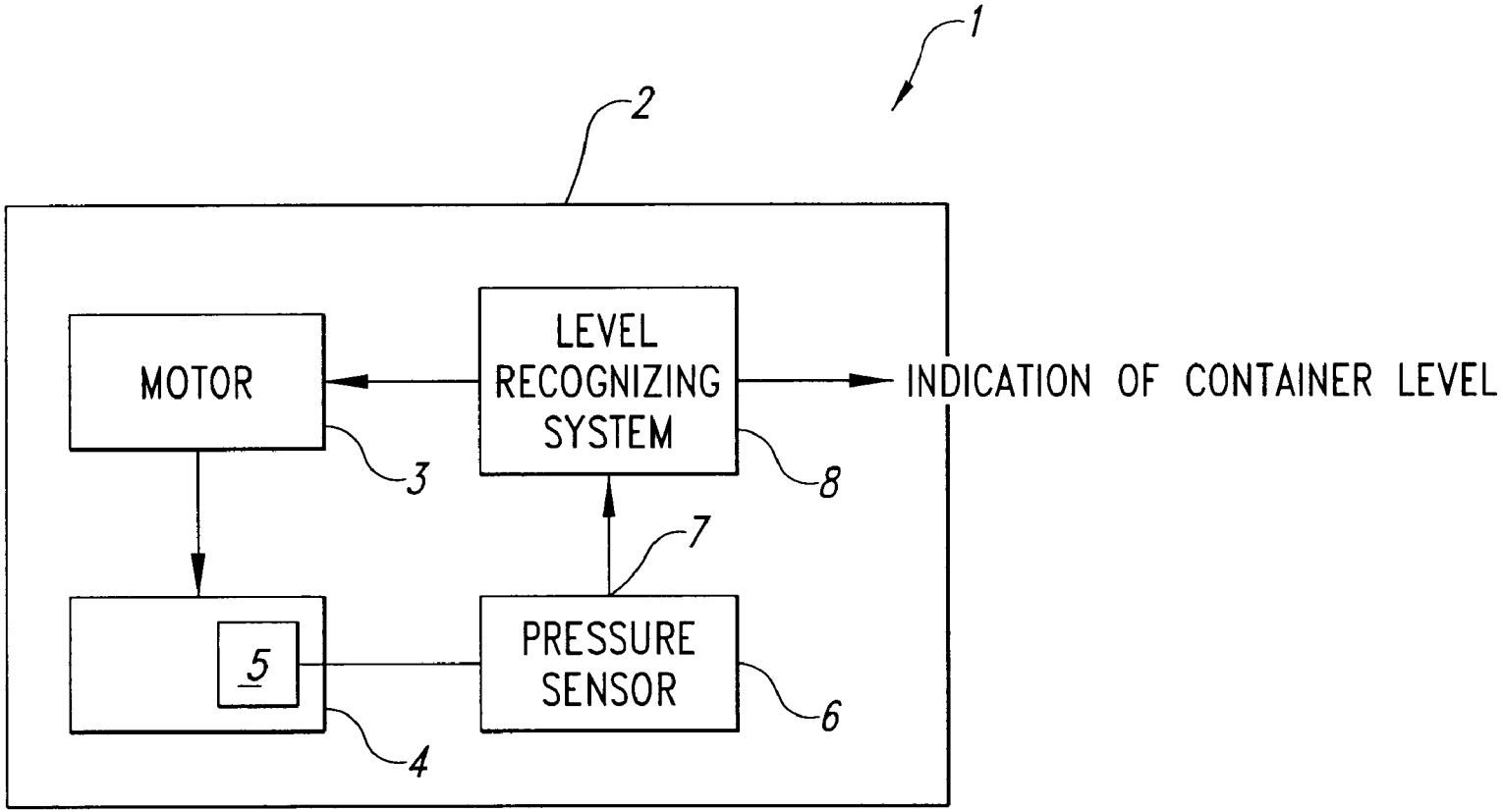
FIG. 1 is a block view of a device that senses and indicates the level of as waste container in a suction system according to the invention.

With reference to FIG. 1, a device is indicated that recognizes and warns of the filling level of a waste container 5 in a suction system.

The suction system is indicated with a block 2 and is intended as being any type of suction cleaner for domestic or industrial use, such as a standard home vacuum cleaner or a central collection system for an industrial installation. The suction system 2 is driven by a motor 3 and provided with an internal chamber 4 that includes a waste container 5 for collected waste material. The internal chamber 4 is kept under suction pressure by the action of the motor 3.

According to embodiments of the invention, a method allows the filling level of the waste container 5 to be measured in the suction system 2.

A pressure sensor 6 is connected to the waste container 5. The sensor 6 detects the suction pressure of the internal chamber 4, or more particularly the difference of pressure between chamber 4 inside the suction device and the external room pressure. The pressure sensor 6 has an output 7 connected to the input of an electronic controller 8 operating in Fuzzy logic, for example a fuzzy processor of the type commercially known as ST52xx, produced by STMicroelectronics. The controller 8 has a second input connected to the motor 3 for recording its rotation speed. Advantageously according to the invention, the controller 8 utilizes information input to it according to the sequence of fuzzy logic rules, below-described in greater detail, in order to supply in output an electric warning signal in correspondence to the filling level of the waste container 5. To this respect it should be noted that the pressure, or relative pressure, in the internal chamber 4 depends both on the state of the waste container 5, and on the type of surface on which one is cleaning.

If the speed of rotation of the motor is held constant, and with predetermined filling level of the waste container 5, the difference of pressure increases as the porosity of the surface being cleaned increases. That is, the pressure differential varies because a more porous surface obstructs the suction head to a greater extent. This statement is validated by experimental trials carried out by the applicant.

Figure 2A:
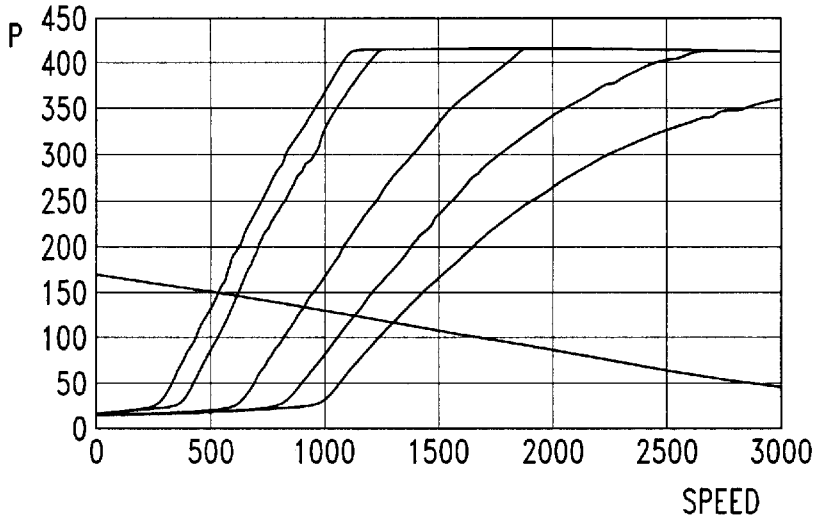
FIGS. 2A, 2B, and 2C are graphs which show patterns of the difference of pressure on three different surfaces, while increasing the speed of the motor with filling levels of the waste container held constant.
Figure 2B:
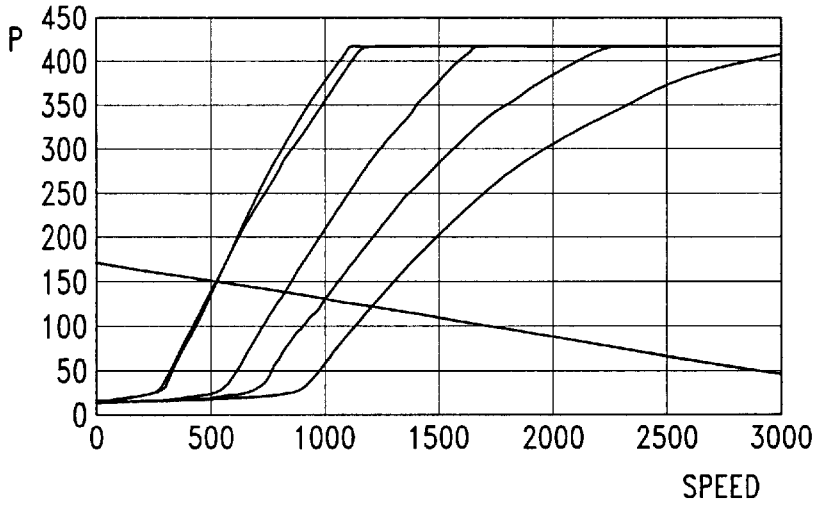
Figure 2C:
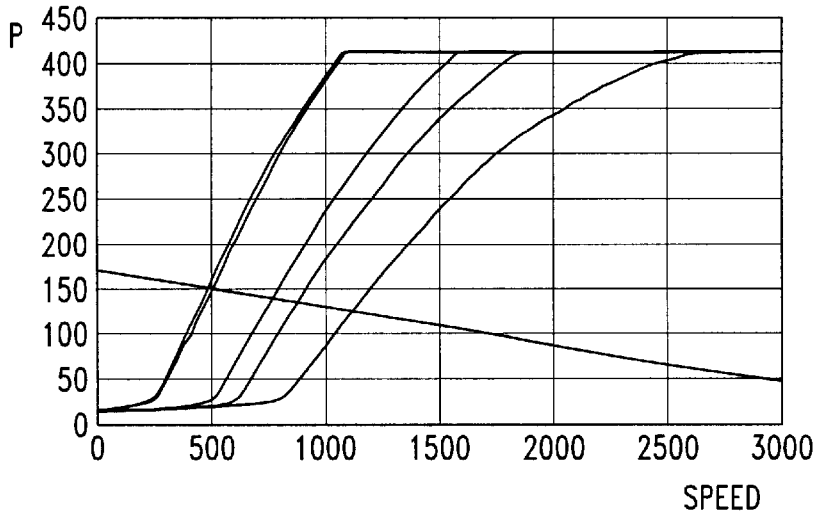

In the herein attached FIGS. 2A, 2B and 2C, comparative diagrams are shown which represent speed-pressure curves for three different types of surfaces, with an increasing motor speed and with the level of fullness of the waste container level held constant. In the FIGS. 2–4, each separate line indicated on the graphs represents a particular level of fullness of the waste container 5, with the least-full level represented by the line on the right, while the most-full level is represented by the line on the left. Intermediate levels of fullness are represented by the lines in the middle of the graphs.

FIG. 2A relates to void, or open suction, while FIGS. 2B and 2C relate to suction on a floor and on a carpet, respectively. From these results it can be seen that it is possible to identify the level of filling of the waste container, according to the difference in pressure, having the added information relative to the type of surface.

Suppose for example of having fixed a void suction as reference. This condition can be reached by simply lifting the extremity of a suction tube of the vacuum cleaner. Measuring the difference of pressure on the variation of the speed of the motor and with varying levels of filling of the waste container 5, the pressure curves reported in FIG. 3 by are obtained. From these curves it is possible to note that the more full the waste container 5 becomes, so the pressure values increase relative to the same motor speed.

Figure 3:
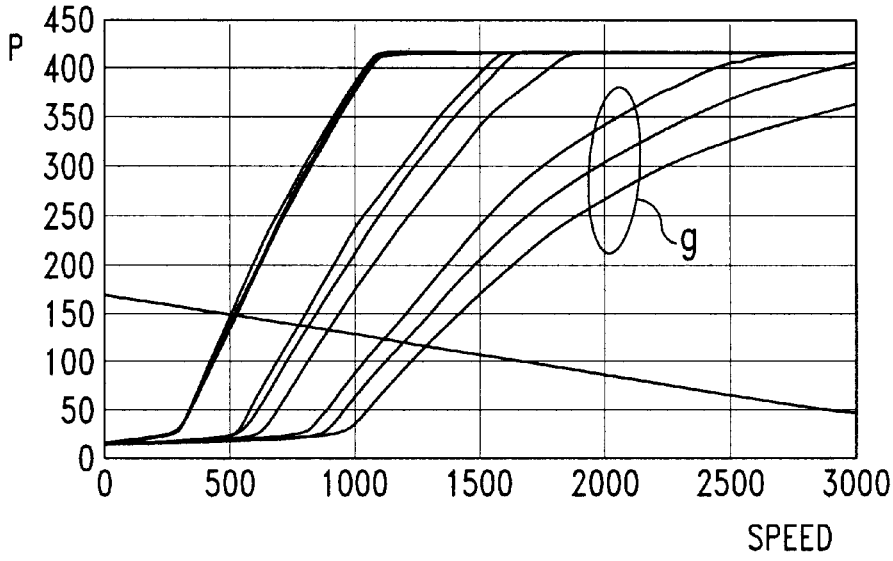
FIG. 3 is a diagram which shows a pattern of the difference in pressure on three different surfaces, on varying the speed of the motor and of the filling of the waste container.

In FIG. 3, the three curves on the right indicated with 9 are those recorded corresponding to the empty container. Proceeding toward the left, the curves are parametrised for the increasing values of filling of the waste container.

Advantageously according to embodiments of the invention, this relation has been formalized through a set of rules in Fuzzy logic. By using these rules in combination with the electronic controller 8, an estimation of the level of fullness of the waste container 5 is carried out, which can be indicated to the user in a conventional manner.

Figure 4:
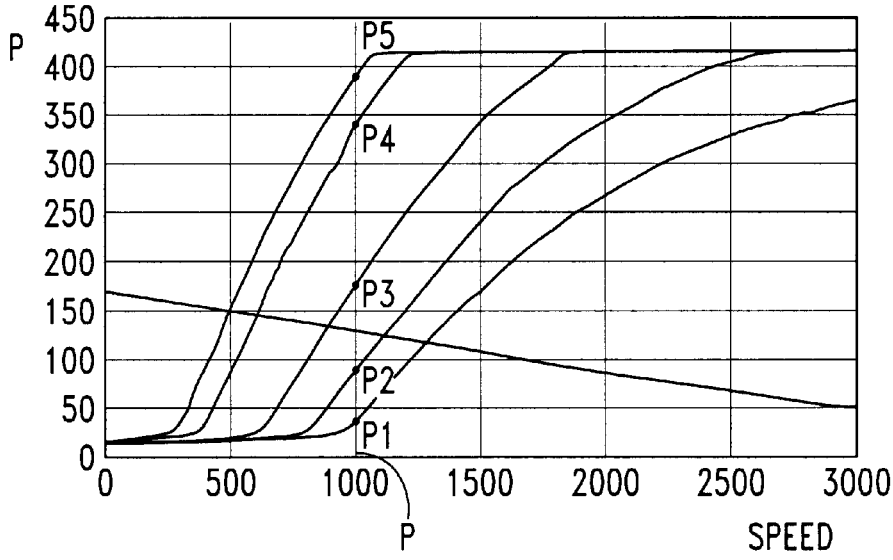
FIG. 4 is a diagram which shows a pattern of the difference of pressure on varying the filling level of the waste container.

As an example, consider FIG. 4 which shows a diagram of the pattern of the difference in pressure to the varying of the level of fullness of the waste container. With reference to point P on the abscissa of the graph shown in FIG. 4, the points p1, p2, p3, p4, p5 represent pressure values taken for various levels of fullness of the waste container 5. The curve on which p1 is a point is taken in correspondence to void. Proceeding through the points p2–p5 the respective corresponding curves are parametrised for increasing values of fullness of the waste container. In correspondence to a specific motor speed the pressure values p1, p2, p3, p4, p5 are recorded.

According to embodiments of the invention such values are utilized as centroids in the semantics of the rules in Fuzzy logic. More in particular, the above mentioned values are made correspondent to the following fuzzy terms: very_low, low, medium, high, very_high for a variable "pressure". Making correlations in Fuzzy logic based on known data values is conventional.

Figure 5:
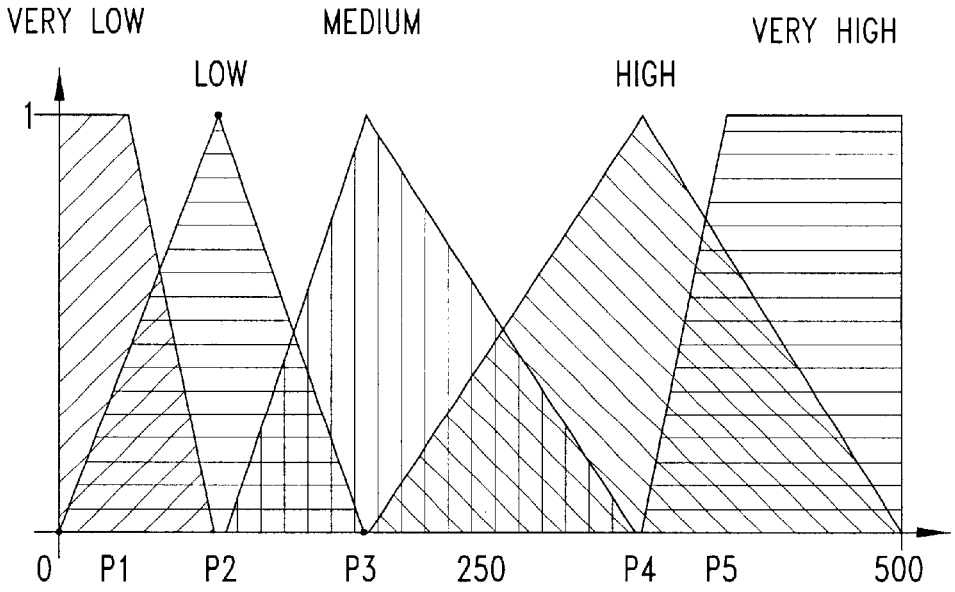
FIG. 5 is a graph showing a diagram with Fuzzy logic functions involving a variable "pressure".
Figure 6:
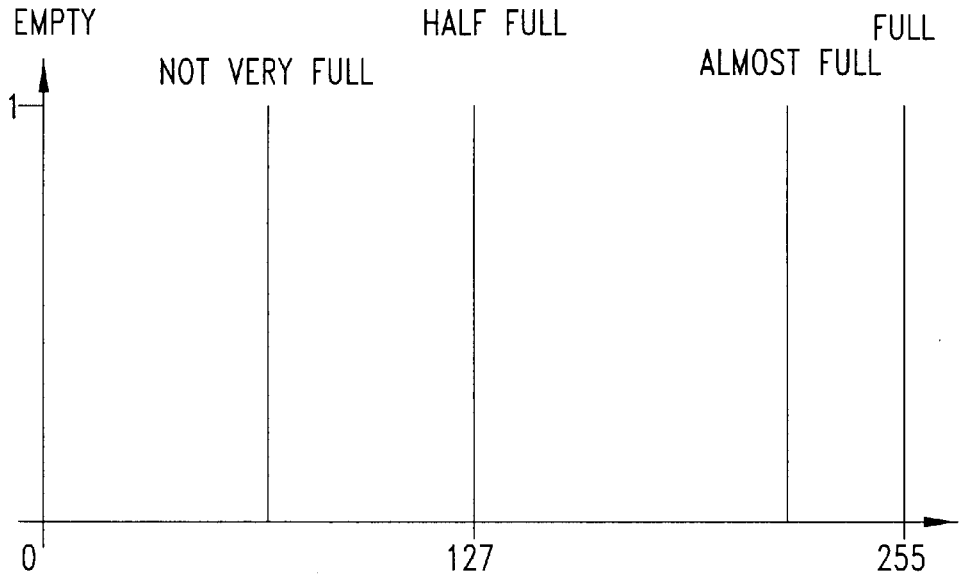
FIG. 6 is a graph schematically showing a diagram with Fuzzy logic functions involving a variable "filling level".

FIG. 5 schematically shows a diagram of functions belonging to fuzzy logic inherent to variable "pressure". A similar type diagram shown in FIG. 6 shows a group of functions belonging to a "crisp" type to each of which an identifying term of the state of fullness of the waste container 5 corresponds. For example, in FIG. 6 the terms Empty, Not Very_Full, Half_Full, Almost_Full, and Full are indicated which closely describe the level of fullness of the waste container.

The relationship between the group of above mentioned terms and their state of filling of the container can be expressed by the following group of fuzzy rules:

IF pressure IS Very_Low THEN the container IS Empty
IF pressure IS low THEN the container IS Not Very_Full
IF pressure IS medium THEN the container IS Half_Full
IF pressure IS High THEN the container IS Almost_Full
IF pressure IS Very_High THEN the container IS Full These relationships are conventionally stored in Fuzzy logic rules in the electronic controller 8, which is used to generate the instantaneous indications of the level of fullness of the waste container for display to the user.

The method and the device according to embodiments of the invention have the great advantage of allowing the monitoring not only when the waste container 5 is full, but also the level of filling. This information is important both for verifying if it is necessary to empty the waste container, and also in view of being able to modulate the suction according to the surface on which one is working. In the latter case, the surface currently being vacuumed must be recognizable in order to generate the current level of fullness of the waste container 5.

What is claimed is:

1. A method for recognizing and warning of the level of filling of a waste container in a system of suction that includes a suction appliance driven by a motor and provided with an internal chamber maintained under suction pressure and also includes the waste container, the method comprising measuring a difference in pressure between the internal chamber and a room outside the suction appliance and elaborating the measured difference according to a set of rules in fuzzy logic for producing an electric signal corresponding to a fullness level of the waste container.

2. The method according to claim 1 wherein the measuring is carried out based on a variation of a rotation speed of the motor.

3. The method according to claim 1, wherein the measuring is referred to a same surface on which the suction is carried out.

4. The method according to claim 1, wherein the relationship between the set of rules in fuzzy logic and the state of fullness of the waste container is expressly by means of the following group of fuzzy rules:

IF pressure IS Very_Low THEN the container is Empty
IF pressure IS Low THEN the container IS Not Very_Full
IF pressure IS Medium THEN the container IS Half_Full
IF pressure IS High THEN the container IS Almost_Full
IF pressure IS Very_High THEN the container IS Full.

5. A device for recognizing and signaling of fullness level of a waste container in a system of suction comprising a suction appliance driven by a motor and provided with an internal chamber kept under suction pressure and comprising the waste container, wherein the device comprises a pressure sensor connected to said chamber for detecting a suction pressure value of the waste container and an electronic controller coupled to the sensor and operating in fuzzy logic for determining the fullness level of the waste container based on the suction pressure value sensed by the sensor and for supplying in output an electric signal corresponding to the fullness level of the waste container, the controller being programmed to produce values of the electric signal corresponding to a plurality of values of the fullness level in addition to a fullness level value corresponding to a completely full waste container.

6. The device according to claim 5 wherein said controller is further connected to said motor in order to be able to receive a rotation speed measurement of the motor.

7. The device according to claim 5 wherein said suction pressure value is measured as difference of pressure between said internal chamber and the area outside the vacuum cleaner.

8. The device according to claim 5 wherein said electronic controller is a fuzzy processor.

9. A suction system comprising:

a sucking appliance driven by a motor and provided with an internal chamber kept under suction pressure;

a waste container positioned within the internal chamber; and a device for recognizing and signaling a fullness level of the waste container including a pressure sensor connected to said chamber for detecting a suction pressure value of the chamber and waste container; and an electronic controller downstream of the sensor and operating in fuzzy logic for supplying in output an electric signal corresponding to the fullness level of the waste container, the controller being programmed to produce values of the electric signal corresponding to a plurality of values of the fullness level in addition to a fullness level value corresponding to a completely full waste container.

10. In a suction system including a motor, an internal chamber maintained under suction pressure by the motor, and a waste container, a method to sense a fullness level of the waste container comprising:

measuring a difference in pressure between the internal chamber and an area outside the internal chamber; and processing the measured pressure difference according to a set of fuzzy logic rules to obtain an output signal corresponding to the fullness level of the waste container, the processing including producing values of the output signal corresponding to a plurality of values of the fullness level in addition to a fullness level value corresponding to a completely full waste container.

11. The method of claim 10 wherein the processing takes into consideration a rotation speed of the motor.

12. The method of claim 10 wherein the processing takes into consideration a surface on which the suction is performed.

13. The method of claim 10 further comprising converting the output signal into a indication of fullness of the waste container that can be sensed by an operator of the suction system.

14. The method of claim 13 wherein the indication of fullness of the waste container is continuously presented to the operator.

15. In a suction system including a motor, an internal chamber maintained under suction pressure by the motor, and a waste container, a method to sense a fullness level of the waste container comprising:

measuring a difference in pressure between the internal chamber and an area outside the internal chamber; and processing the measured pressure difference according to a set of fuzzy logic rules to obtain an output signal corresponding to the fullness level of the waste container, wherein a relationship between the set of fuzzy logic rules and the fullness level of the waste container comprises the following relations:

IF pressure IS Very_Low THEN the waste container is Empty

IF pressure IS Low THEN the waste container IS Not Very_Full

IF pressure IS Medium THEN the waste container IS Half_Full

IF pressure IS High THEN the waste container IS Almost_Full

IF pressure IS Very_High THEN the waste container IS Full.

16. A suction device comprising:

a motor;

an internal chamber able to be kept under suction pressure by the motor;

a waste container portion of the internal chamber;

a pressure sensor coupled to the internal chamber having an output terminal; and a fuzzy logic programmed electronic controller having an output terminal and having an input terminal coupled to the output terminal of the pressure sensor, the electronic controller structured to provide an electric signal at its output terminal responsive to the pressure sensor output, the electric signal corresponding to the fullness level of the waste container, the controller being programmed to produce values of the electric signal corresponding to a plurality of values of the fullness level in addition to a fullness level value corresponding to a completely full waste container.

17. The suction device of claim 16 wherein the electronic controller further comprises a second input terminal structured to accept a signal corresponding to a type of surface on which the suction device operates, the controller being programmed to determine the fullness level based on the pressure sensor output and on the signal corresponding to the type of surface on which the suction device operates.

18. The suction device of claim 17 wherein the electronic controller further comprises a third input terminal structured to accept a signal corresponding to a rotation speed of the motor, the controller being programmed to determine the fullness level based on the pressure sensor output, on the signal corresponding to the type of surface on which the suction device operates, and on the rotation speed of the motor.

19. The suction device of claim 16 wherein the pressure sensor is structured to measure a difference of pressure between the internal chamber and an area outside the suction device.

20. The suction device of claim 16 further comprising a level indicator coupled to the output terminal of the electronic controller.

21. A suction device comprising:

a motor;

an internal chamber able to be kept under suction pressure by the motor;

a waste container portion of the internal chamber;

a pressure sensor coupled to the internal chamber having an output terminal; and a fuzzy logic programmed electronic controller having an output terminal and having an input terminal coupled to the output terminal of the pressure sensor, the electronic controller structured to provide an electric signal at its output terminal responsive to the pressure sensor output, the electric signal corresponding to the fullness level of the waste container, wherein the electronic controller is programmed with the following relations:

IF pressure IS Very_Low THEN the waste container is Empty

IF pressure IS Low THEN the waste container IS Not Very_Full

IF pressure IS Medium THEN the waste container IS Half_Full

IF pressure IS High THEN the waste container IS Almost_Full

IF pressure IS Very_High THEN the waste container IS Full.

* * * * *